United States Patent [19]

Plichta

[11] 4,422,378

[45] Dec. 27, 1983

[54] MEANS FOR AND A METHOD OF INITIATING EXPLOSIONS

[75] Inventor: Bohumil M. J. Plichta, Kempton Park, South Africa

[73] Assignee: Imperial Chemical Industries PLC, London, England

[21] Appl. No.: 330,584

[22] Filed: Dec. 14, 1981

[30] Foreign Application Priority Data

Dec. 11, 1980 [ZA] South Africa ..... 80/7774

[51] Int. Cl.[3] ..... F42C 11/00

[52] U.S. Cl. ..... 102/206

[58] Field of Search ..... 102/206, 217, 218; 361/247, 248

[56] References Cited

U.S. PATENT DOCUMENTS

| | | | |
|---|---|---|---|
| 2,396,914 | 3/1946 | Cook . | |
| 3,166,689 | 1/1965 | Butenbach . | |
| 3,171,063 | 2/1965 | Hutchison et al. | 102/206 |
| 3,255,366 | 6/1966 | McNulty . | |
| 4,041,870 | 8/1977 | Ettel . | |
| 4,141,297 | 2/1979 | Sellwood | 102/206 |
| 4,273,051 | 6/1981 | Stratton | 102/206 |
| 4,297,947 | 11/1981 | Jones et al. | 102/206 |

FOREIGN PATENT DOCUMENTS

| | | |
|---|---|---|
| 5377 | 11/1979 | European Pat. Off. . |
| 2294424 | 7/1976 | France . |
| 646013 | 11/1950 | United Kingdom . |
| 1276766 | 6/1972 | United Kingdom . |
| 1421578 | 1/1976 | United Kingdom . |
| 2022222 | 12/1979 | United Kingdom . |
| 1558875 | 1/1980 | United Kingdom . |
| 1578658 | 11/1980 | United Kingdom . |

*Primary Examiner*—Charles T. Jordan

*Attorney, Agent, or Firm*—Cushman, Darby & Cushman

[57] ABSTRACT

An alternating current generator for use as a shot exploder suitable for firing electric detonators coupled through toroid transformers e.g. 'Magnadet' detonators. The detonating system is energized by means of a signal that is automatically generated at the resonant frequency, thus avoiding the usual time-consuming and dangerous practice involving in-situ determination of inductance and selection of capacitors. A power oscillator having a transistor is used to supply the energizing signal. This transistor is switched by a current feedback signal. In the preferred form a transformer is located in series with the output, the secondary of the transformer driving the transistor.

9 Claims, 5 Drawing Figures

MEANS FOR AND A METHOD OF INITIATING EXPLOSIONS

This invention relates to a means for and a method of initiating explosions. More particularly, it relates to a means and method utilisable with toroid coupled detonators such as that developed by ICI and marketed under the trade name "Magnadet".

Toroid coupled detonators such as that described above are used together with ferrite rings. Each detonator has its own associated ring, with the leading wire from each detonator being threaded several times (typically 4 turns) about its associated ring, to form a secondary circuit. The length of the leading wires is such as to ensure that the rings are situated at the mouth of each blast hole and energy is fed from an exploder to the system via a primary wire which is threaded once only through each ring.

With such a system described above, an attractive feature is the frequency selective characteristics of the ferrite rings. Thus, the rings have a band-pass characteristic which effectively attenuates low frequency signals having a frequency below about 10 kHz and high frequency signals having a frequency above about 100 kHz. Thus, as the leading wire of each detonator constitutes an isolated closed loop the detonators are substantially immune to stray currents and earth leakage.

A problem with such systems is that at frequencies of 15–25 kHz (which is the frequency range in which the best energy transfer is obtained via the ferrite rings) there is a considerable loss of firing energy due to the inductance of the system.

The applicant is aware that an attempt has been made to overcome this problem by utilising a series capacitor in an attempt to operate the system in a series resonant mode.

However, it will be appreciated, that the inductance of the system will vary in accordance with the number of ferrite ring and associated detonator units utilised, the configuration of the primary wire, and the like. Thus, if a shot exploder is used which generates a detonating signal at a fixed frequency, then each system will require a series capacitor having a particular capacitance that will result in series resonance at the fixed frequency. It is thus necessary to measure the inductance of each system in situ, compute the capacitance required, select a suitable capacitor from a stock thereof, and then insert the capacitor in circuit with the system. This procedure is time consuming, dangerous, and requires a stock of capacitors and skilled personnel.

Accordingly, the invention provides a means for initiating explosions which includes a power oscillator means for generating an oscillating electric initiating signal of sufficient power at a variable frequency and having a current controllable element;

an output connecting means for connection to a primary wire of an A.C. operable detonating system for supplying the initiating signal thereto; and a frequency setting means to which the oscillator means is responsive whereby, in use, when the power oscillator means is connected to a load it automatically generates a signal at the resonant frequency of the load, the frequency setting means including a positive feedback link for supplying to the controllable element a feedback current control signal.

The invention extends to an initiating means as described, in combination with and connected to an A.C. operable detonating system.

Those skilled in the art will appreciate that the operating frequency of oscillators is normally determined by suitable elements or networks. With the shot exploder of the invention, the detonating system itself may, in use, constitute part of the oscillator means.

The, or each, controllable element may be switchable and may conveniently be switchable on and off, such as a transistor. This switchable element is then switched in phase with the initiating signal.

Conveniently, the feedback link may supply a current control signal that is proportional to the current of the initiating signal. One form of feedback linking means may include a transformer whose primary current is the initiating signal current and whose secondary current controls the said controllable element or elements.

The shot exploder may also include a timing means such that a detonating signal is supplied for a predetermined period of time.

The shot exploder of the invention makes it unnecessary first to determine the inductance of a detonating system and then to compensate therefor by means of a resonance capacitor to obtain a predetermined resonant frequency. Thus, the detonating system in energised by means of a signal that is automatically generated at the resonant frequency.

The invention is now described, by way of examples with reference to the accompanying drawings, wherein all like components are similarly referenced and in which.

Figure 1:
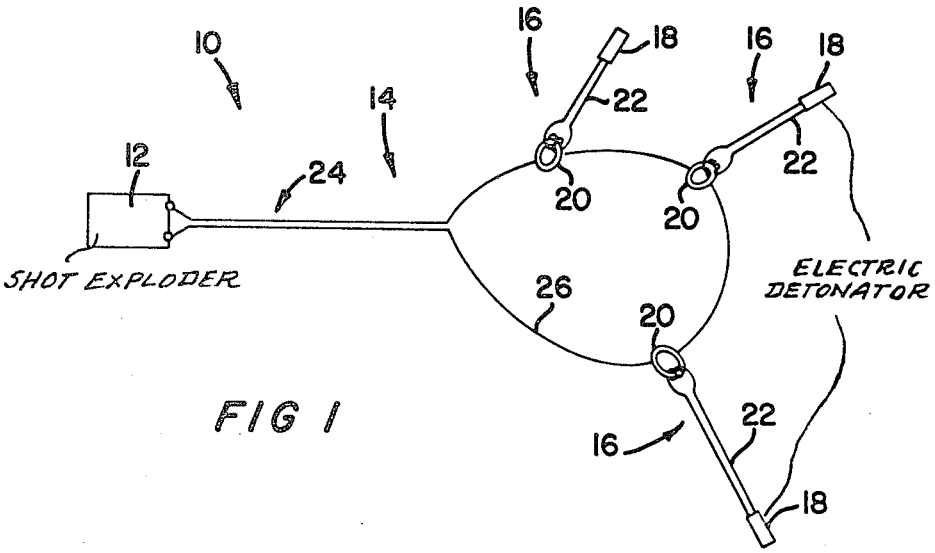
FIG. 1 shows schematically a detonating system of the type with which a shot exploder in accordance with the invention is used.

Reference is initially made to FIG. 1. Shown therein generally by reference numeral 10 is a detonating arrangement. The detonating arrangement 10 comprises a shot exploder 12 connected to a detonating system 14. The detonating system 14 comprises a number of detonating modules 16. Each detonating module 16 comprises a standard electric detonator 18 which is coupled with a ferrite ring 20 by means of a loop of leading wire 22. As shown, each leading wire 22 is wound a few times around its ferrite ring 20. The detonating system 14 further comprises a firing cable 24 and a primary wire loop 26, the latter being passed through the ferrite rings 20. Further as shown, one end of the firing cable 24 is connected to the shot exploder 12 and the other end to the primary wire loop 26.

Figure 2:
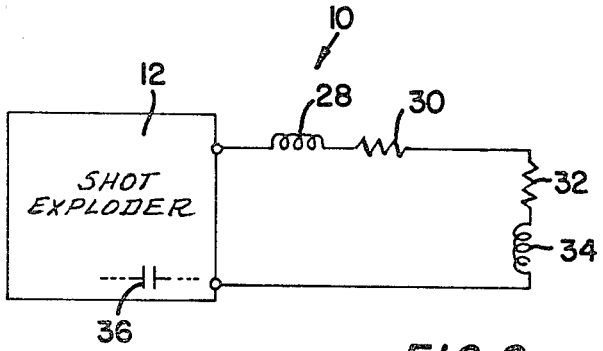
FIG. 2 shows an equivalent circuit of the detonating system.

Referring now to FIG. 2, an equivalent circuit diagram of the detonating arrangement 10 is shown. Thus, the firing cable 24 and primary wire loop 26 are represented by an inductance 28 and a resistance 30 whereas the detonating modules 16, as referred back to the primary loop 26, are represented by a resistance 32 and an inductance 34. The inductance 28 typically has a value of 60–600 $\mu$H and the resistance 30 has a value of 5–10 ohm. Similarly, the resistance 32 has a value of $N \times 0.125$ ohm where N is the number of detonators and the inductance 34 has a value of N×2.5 μH. As indicated earlier, the ferrite rings 20 are frequency selective and have an optimal energy transfer characteristic in the frequency range of 15–25 kHz. It will thus further be appreciated that at these frequencies the inductive characteristic of the detonating system 14 is significant. In order to eliminate the inductive effect the shot exploder 12 incorporates a series capacitor 36 which is of a suitable value so that when used with detonating systems 14 of a specified type the series resonant circuit formed thereby has a resonant frequency between 15 and 25 kHz.

Figure 3:
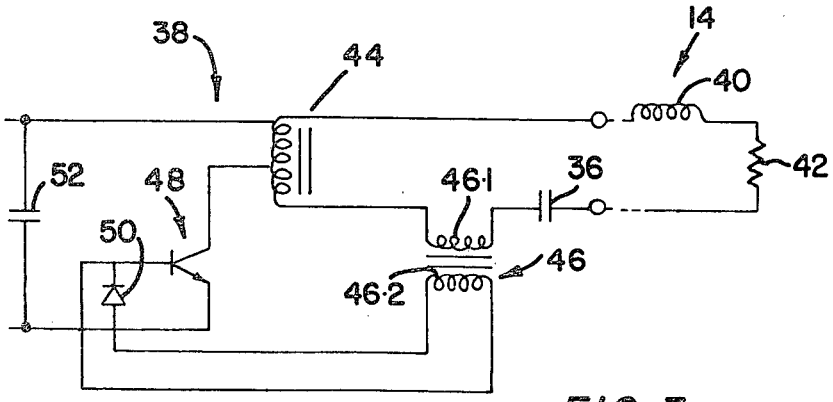
FIGS. 3 and 4 show two circuit diagrams of power oscillators used with a shot exploder of the invention utilising a transformer coupled feedback link.

Refering now to FIG. 3, shown therein is a power oscillator arrangement 38 which is connected to the detonating system 14. In FIG. 3, the inductances and resistances shown in FIG. 2 have been lumped together to provide an inductance 40 and a resistance 42. The oscillator arrangement 38 further has an auto-transformer 44 and a step-down current feedback transformer 46. The auto-transformer 44 is serially connected with the detonating system 14 via the primary winding 46.1 of the feedback transformer 46 and the resonance capacitor 36. At the heart of the oscillator arrangement 38 is a transistor 48 which is controlled by a feedback loop from the secondary winding 46.2 of the feedback transformer 46. In order to protect the base-emitter junction of the transistor 48a reverse polarity free-wheeling diode 50 is provided. An energy storage capacitor 52 is also provided.

It will be appreciated that the oscillator arrangement 38 is self-tuning in that it will generate an oscillating signal at the resonant frequency of the circuit formed by the auto-transformer 44, the feedback transformer 46, the resonance capacitor 36 and the detonating system 14. Thus, in operation, once the oscillator arrangement 38 is triggered (as is indicated below with reference to FIG. 5) the transistor 48 is switched on and current starts to flow through the primary winding 46.1. The polarity of the secondary winding 46.2 is chosen such that positive feedback to the transistor 48 is provided. Thus the transistor 48 remains switched on while the output current flows in the original direction. When current flow reverses the transformer 46 turns the transistor 48 off. With the next reversal of current polarity, to the original direction, the transistor 48 is switched on again and the process is repeated. The positive feedback signal applied to the switching transistor 48 is proportional to the load current and is always in phase with it. The oscillator arrangement 38 accordingly generates a signal at the resonant frequency of the load, providing the inductance of the load circuit is within reasonable limits (say 50 μH to 1 mH).

Figure 4:
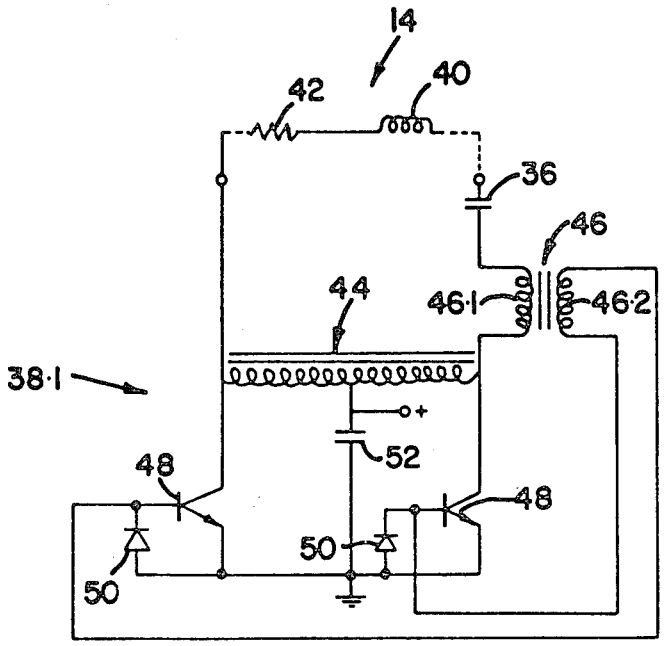

Referring to FIG. 4 an alternative oscillator arrangement 38.1 is shown. This arrangement 38.1 is similar to the arrangement 38 of FIG. 3, except that two transistors 48 are used in a push-pull configuration. The various components shown in FIG. 4 are similarly referenced to those in FIG. 3. As the operation of the circuit shown in FIG. 4 will be self-evident to those skilled in the art if reference is made to FIG. 3, it will not be described further.

Although the auto-transformer 44 produces a square-wave output voltage signal, the current in the firing loop is sinusoidal as known from the theory of resonant circuits. The firing current therefore contains a low proportion of harmonic frequencies. This is a very useful feature of the exploder—although the harmonics consume the exploder output power, they are attenuated by the ferrite rings and by the inductance of the detonator leading wires and therefore they contribute very little to the transfer of energy to the detonators.

Figure 5:
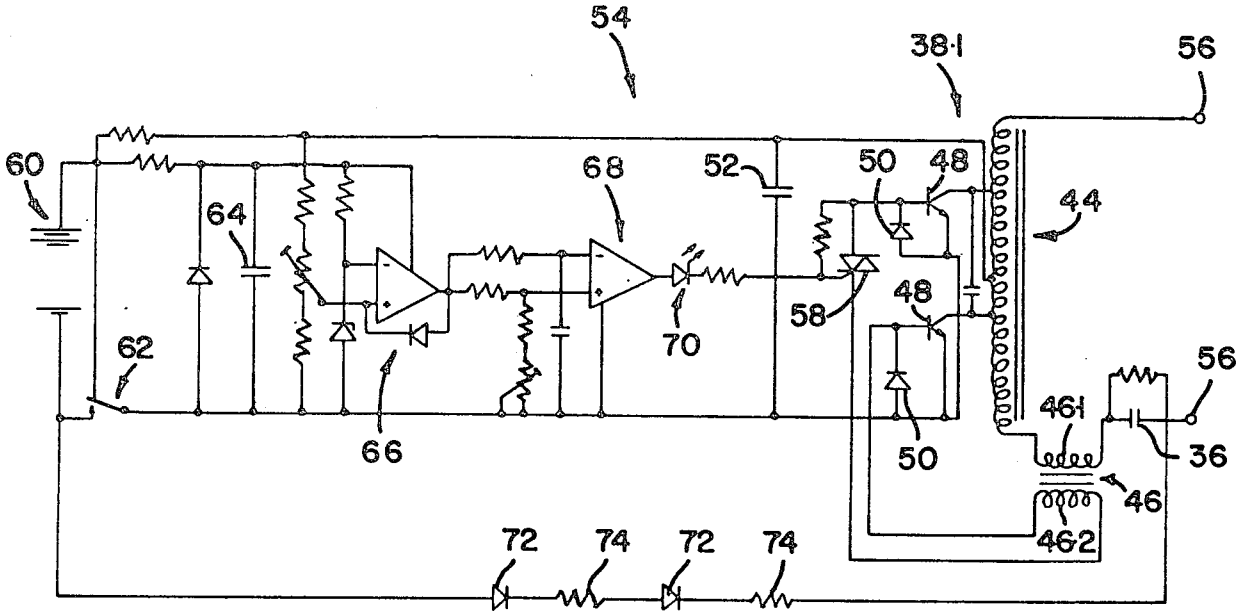
FIG. 5 shows the circuit diagram of a shot exploder in accordance with the invention, incorporating the circuit of FIG. 4.

Reference is now made to FIG. 5. Shown therein is a circuit diagram of a shot exploder 54 in accordance with the invention. The shot exploder 54 has output terminals 56 to which a detonating system such as that described earlier and referred to by reference number 14 may be connected. The shot exploder 54 also has a power oscillator arrangement 38.1 similar to that shown in FIG. 4 and similarly referenced. However, the auto transformer 44 is a step-up transformer which provides an output signal of about 115 volts peak with a supply voltage of about 35 volts. A controlling triac 58 is also provided in series with the secondary winding 46.2. It will be appreciated by those skilled in the art that when the triac 58 is switched on its associated transistor 48 will be triggered thereby starting up the oscillator arrangement 38.1. Further, whilst the triac 58 is energised the oscillator arrangement 38.1 is enabled. The shot exploder 54 further has a rechargeable battery 60 and a key-operated switch 62. In the position shown in FIG. 5, the switch 62 is off and the exploder 54 is inoperative.

When the switch 62 is closed a storage capacitor 64 is charged. The voltage across the capacitor 64 is monitored by a level detector 66 which provides an output signal when the voltage across the capacitor 64 is at a specified value (35 volts). The level detector 66 operates a timer 68 which supplies an output signal of about 4.5 mS duration. The output signal of the timer 68 energises a light emitting diode 70 and also energises the triac 58 which thereby triggers the oscillator arrangement 38.1 and enables it for the 4.5 mS. With a detonating system connected across the output terminals 56 an oscillating signal at resonant frequency is then supplied to the detonating system which initiates the detonators of the system. It will be noted that the battery 60 may also be charged via the output terminals 56, a unidirectional charging link being provided by diodes 72 and resistors 74.

I claim:

1. A means for initiating explosions which includes a power oscillator means for generating an oscillating electric initiating signal of sufficient power at a variable frequency and having a current controllable element;

an output connecting means for connection to a primary wire of an A.C. operable detonating system for supplying the initiating signal thereto; and a frequency setting means to which the oscillator means is responsive whereby, in use, when the power oscillator means is connected to a load it automatically generates a signal at the resonant frquency of the load, the frequency setting means including a positive feedback link for supplying to the controllable element a feedback current control signal.

2. An explosion initiating means as claimed in claim 1, in which the feedback link is such as to supply, in use, a fedback current control signal that is proportional to the current of the initiating signal.

3. An explosion initiating means as claimed in claim 1, in which the feedback link includes a transformer having a primary winding and a secondary winding, the primary winding being serially connected with the output connecting means, and the secondary winding being connected in a positive feedback manner to the power oscillator means.

4. An explosion initiating means as claimed in claim 1, in which the frequency setting means includes a resonance capacitor serially connected with the output connecting means.

5. An explosion initiating means as claimed in claim 4, in which the controllable element is a switchable element and the frequency setting means is controllably connected with the switchable element to switch it, in use, in phase with the initiating signal.

6. An explosion initiating means as claimed in claim 3 in which the secondary winding of the frequency setting transformer is connected directly to the controllable element.

7. An explosion initiating means as claimed in claim 1, in which the power oscillator means includes an output transformer.

8. An explosion initiating means as claimed in claim 1, which includes a timing means for providing that the initiating signal is supplied for a predetermined period of time.

9. An explosion initiating means as claimed in claim 1, in combination with and connected to an A.C. operable detonating system.

* * * * *